US005081717A

United States Patent [19]

Shedd et al.

[11] Patent Number: 5,081,717

[45] Date of Patent: Jan. 21, 1992

[54] HEADGEAR ATTACHMENT

[76] Inventors: Aaron N. Shedd; Mary E. Shedd, both of 9306 Convento Ter., Fairfax, Va. 22031

[21] Appl. No.: 601,353

[22] Filed: Oct. 23, 1990

[51] Int. Cl.[5] ..... A42B 1/06

[52] U.S. Cl. ..... 2/199; 2/174; 2/187; 2/209.1

[58] Field of Search ..... 2/171, 174, 185 R, 187, 2/196, 199, 209.1, 410, 172, 207, 417, 418, 423, 425

[56] References Cited

U.S. PATENT DOCUMENTS

| | | | |
|---|---|---|---|
| 270,242 | 1/1883 | Mitchell | 2/199 |
| 822,986 | 6/1906 | Rochet | 2/187 |
| 946,770 | 1/1910 | Sands | 2/187 |
| 1,737,289 | 11/1929 | Young | 2/187 |
| 2,230,805 | 2/1941 | Levy | 2/187 |
| 2,462,679 | 2/1949 | Rosenau | 2/199 |
| 2,501,760 | 3/1950 | Dahlstedt | 2/172 |
| 2,837,746 | 6/1958 | Gundy | 2/187 |
| 2,897,510 | 8/1959 | Robinson | 2/187 |
| 3,828,366 | 8/1974 | Conrad | 2/174 |
| 4,406,296 | 9/1983 | Wexler | 2/209.1 |
| 4,428,079 | 1/1984 | McKee | 2/174 |
| 4,821,341 | 4/1989 | Baptiste | 2/199 |
| 4,980,928 | 1/1991 | Ellis | 2/209.1 |

FOREIGN PATENT DOCUMENTS

| | | | |
|---|---|---|---|
| 559656 | 3/1931 | Fed. Rep. of Germany | 2/174 |
| 1194114 | 11/1959 | France | 2/410 |
| 1377550 | 9/1964 | France | 2/199 |
| 1562082 | 2/1969 | France | 2/199 |
| 2334776 | 7/1977 | France | 2/418 |

*Primary Examiner*—Werner H. Schroeder
*Assistant Examiner*—Diana L. Biefeld

[57] ABSTRACT

This invention provides an accessory for headgear which provides protection of the posterior neck region, both ears and a poriton of either side of the face during inclement weather and exposure to the sun's rays. The headgear attachment is made of lightweight, waterproof, pliable material. The top edge of the protective portion contains a member conformable to the posterior and side portions of the wearer's head. The conformable member may be manually bent to impart a self-sustained shape and to alter the effective length of the top edge of the attachment. By bending and/or folding the conformable member there can be provided a plurality of accommodations such as adjusting the size of the headgear attachment, accommodating the shape of the head, and styling of the entire attachment. The headgear attachment may be attached, detached, and reattached to a cap, hat, headband, scarf, turban, or other head covering by means such as spring-loaded binder clips. The headgear attachment is useful to both male and female wearers of any age. It is especially designed for outdoor use at the beach, baseball games, picnics, and by such persons as golfers, mailmen, policemen, farm workers, construction workers, and small children. It may display advertising or the like.

5 Claims, 8 Drawing Sheets

HEADGEAR ATTACHMENT

BACKGROUND OF THE INVENTION

This invention comprises an accessory for headgear in the form of a headgear attachment designed to provide protection to the neck and the sides of the face. The headgear attachment is of a construction which permits the protective effects to be adjusted to protect a region from the back of the head to a position immediately forward of the ear. It can easily be attached to or removed from many different types of hats, caps, sweatbands, hard hats (construction and factory), and military helmets. It conforms and adjusts to fit all head shapes and sizes.

The insignia cap in the form of the traditional baseball cap, for example, is a popular headgear item. However, such a cap provides no protection to the neck and sides of the face. The instant invention provides an accessory useful with an insignia cap or any other of a wide variety of headgear to provide such protection.

Spectators at winter football games generally suffer from cold wind, snow, or rain. Likewise, spectators at baseball games on hot sunny days can be exposed continuously to the sun's rays. Others who suffer from inclement weather include, but are not limited to, construction workers, policemen, golfers, delivery persons, farmers, farm workers, or others sensitive to sun. The instant invention can be adapted to the headgear worn by individuals ranging from insignia caps to headbands to hard hats.

SUMMARY OF THE INVENTION

The instant invention comprises a headgear accessory, more specifically in the form of a headgear attachment, for providing some light or weather protection to the side and posterior portions of the head and neck of a wearer. The protective accessory generally comprises a flexible shield, for example, a fabric or other sheet-like flexible member, designed to be of a size to overlay the areas desired to be protected. A formable member is provided near one edge of the flexible shield enabling the wearer to shape the shield into conformance with the posterior portion of the head. The accessory is also provided with engagement members to permit the head-conforming shield to be detachably engaged with headgear.

This invention was designed with the objectives of functioning as an accessory with a variety of headgear to protect any wearer from adverse or inclement weather conditions and exposure to the sun's rays.

It is the object of the present invention to provide a protective headgear attachment that can easily be attached to and worn with headgear such as baseball caps, hard hats (construction, factory, and military), and sweatbands.

It is the object of the present invention to provide a protective headgear attachment that can be sized to the individual wearer, ranging from infant to adult, to overlay the area to be protected.

It is the object of the present invention to provide a headgear attachment that can be shaped to conform closely to the contour of the posterior portion of the wearer's head and the rear and side of the neck.

It is the object of the present invention to provide a headgear attachment that can easily be attached, detached, and reattached to many kinds of headgear by a wide variety of engagement members. For example, engagement may be provided by spring-loaded binder clips, Velcro, snaps, buttons, rivets, grommets, plastic strips, and flat bands of plastic, acrylic, or latex-coated wire.

It is the object of the present invention to provide cooling to the neck, face, and ears of the wearer during the hot summer days or in an uncomfortably warm environment.

It is the object of the present invention to provide a protective accessory which can make use of modern insulatory materials hereinafter disclosed.

It is another object of the present invention to provide a protective headgear attachement that can be made from paper, plastic, or woven cloth or screen mesh.

It is the object of the present invention to provide a protective headgear attachment that can be made from reflective material for safety when worn at night.

It is the object of the present invention to provide a headgear attachment that can contribute to festive occasions by providing a large area for exhibition of insignia, colors, shapes, designs, or even advertisements.

It is the object of the present invention to provide a headgear attachment that is reversible, thus providing space on either surface, outside or inside, for the types of displays discussed immediately above.

It is the object of the present invention to provide a headgear attachment that may be treated to assist in repelling of insects.

BRIEF DESCRIPTIONS OF THE DRAWINGS

The attached drawings are illustrative of specific embodiments of the invention. More specifically the content of the drawings is as follows.

Figure 3A:
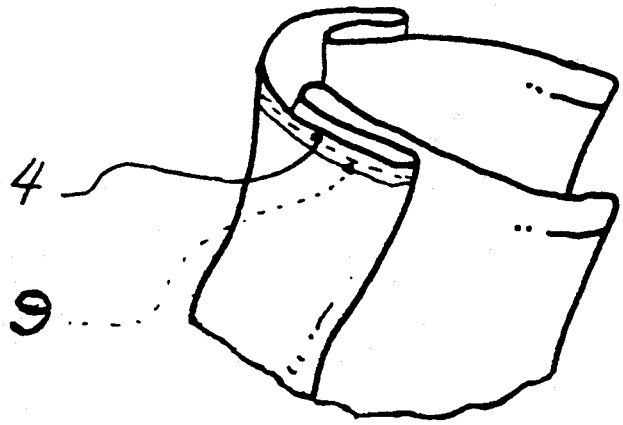
FIG. 3 is a top perspective view of the present invention attached to a baseball cap on a wearer depicting one arrangement to effect a size-reduction of the headgear attachment.

FIG. 3*a* is a perspective view of the present invention not attached to a baseball cap expanded to show greater detail in one arrangement to effect a size reduction of the headgear attachment.

Figure 4:
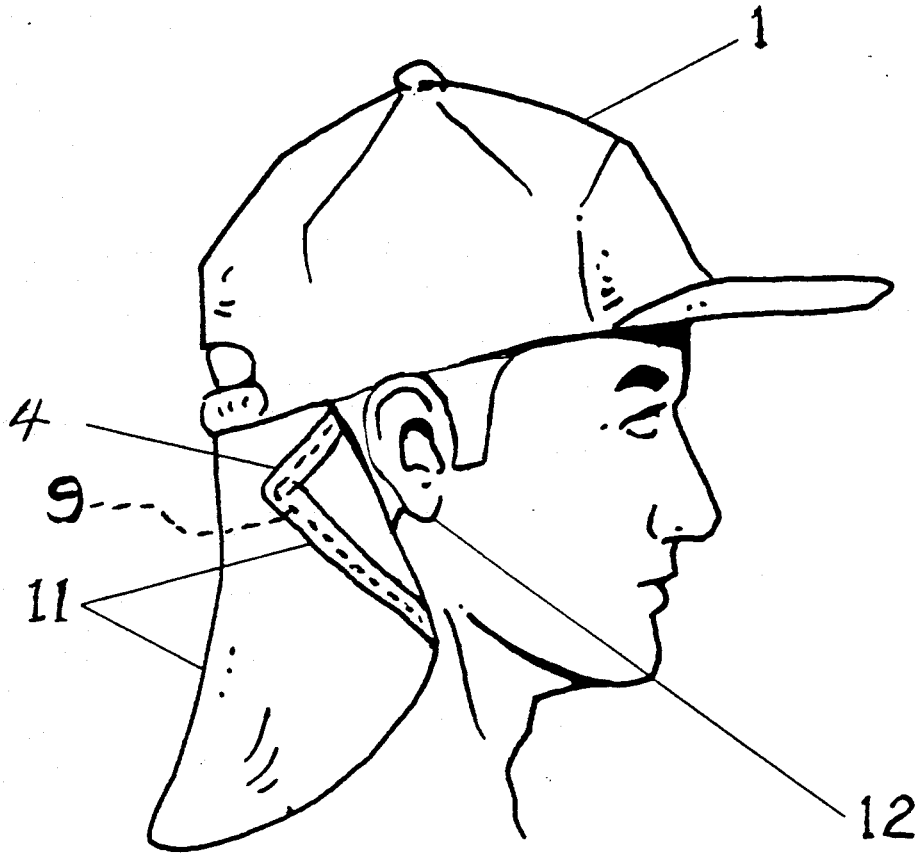

FIG. 4 is a side view of the present invention attached to a baseball cap on a wearer and showing one side of the headgear attachment bent backward to expose the ear.

Figure 5A:
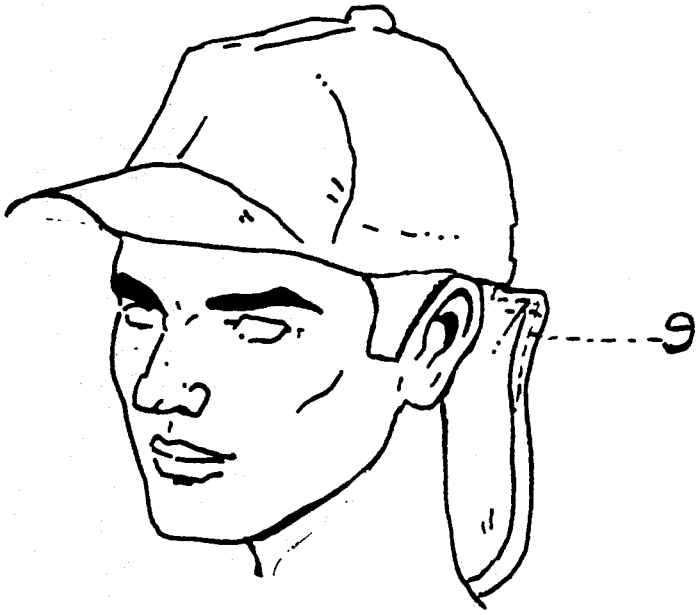
Figure 5:
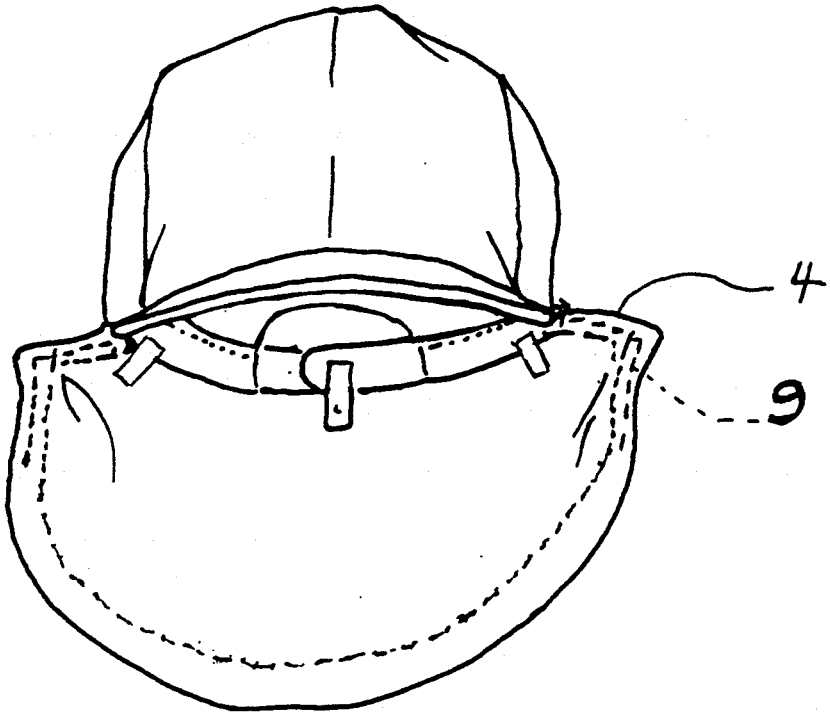

FIG. 5 is a front view of the present invention attached to a baseball cap depicting the headgear attachment bent backward and outward to the side at each side of the wearer's head.

FIG. 5*a* is a side view of the present invention attached to a baseball cap on a wearer's head showing one side of the headgear attachment bent backward to expose the ear and provide greater space for the flow of air between the head and neck of the wearer and the headgear attachment.

Figure 6A:
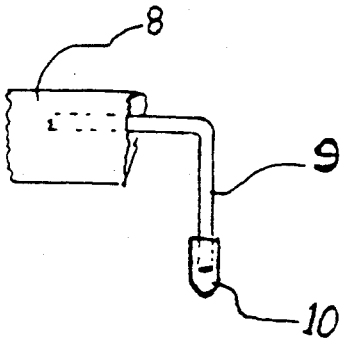
Figure 6:
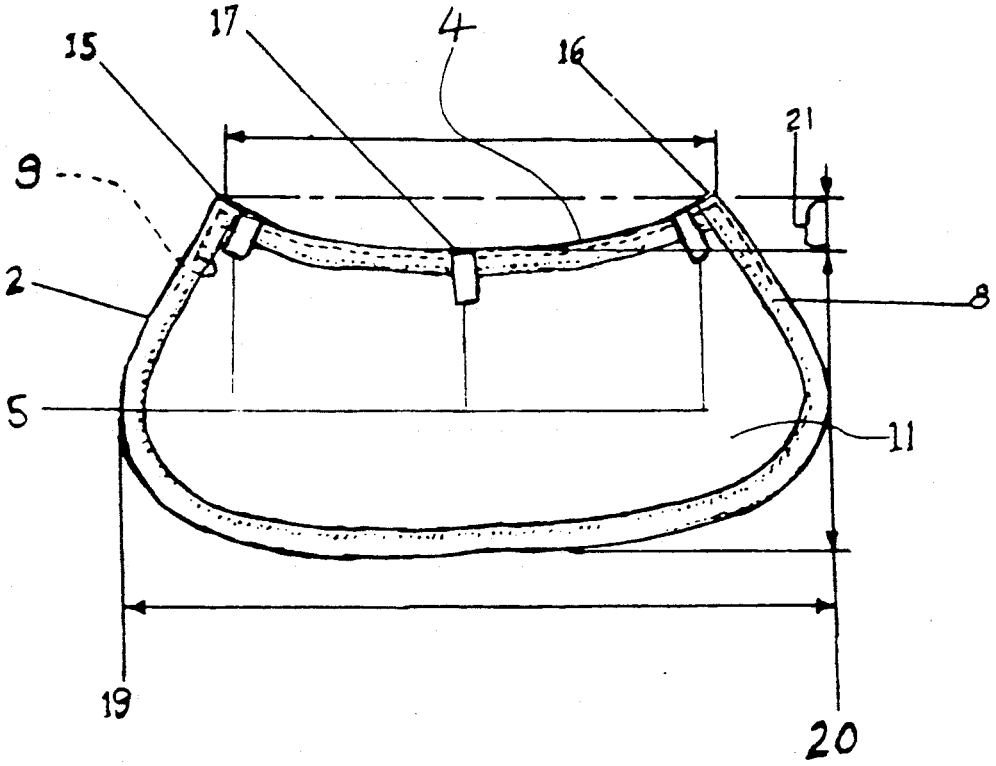

FIG. 6 is an inside, flat, plan view of the present invention depicting the outline and shape of the headgear attachment and the location of the conforming member on the headgear attachment; and the location of the attaching members on the shield.

FIG. 6*a* is a cutaway view of the bias tape at the upper right hand corner of FIG. 6 showing the location of the conforming member on the headgear attachment; also visible is a safety tip at one end of the conforming member.

Figure 7:
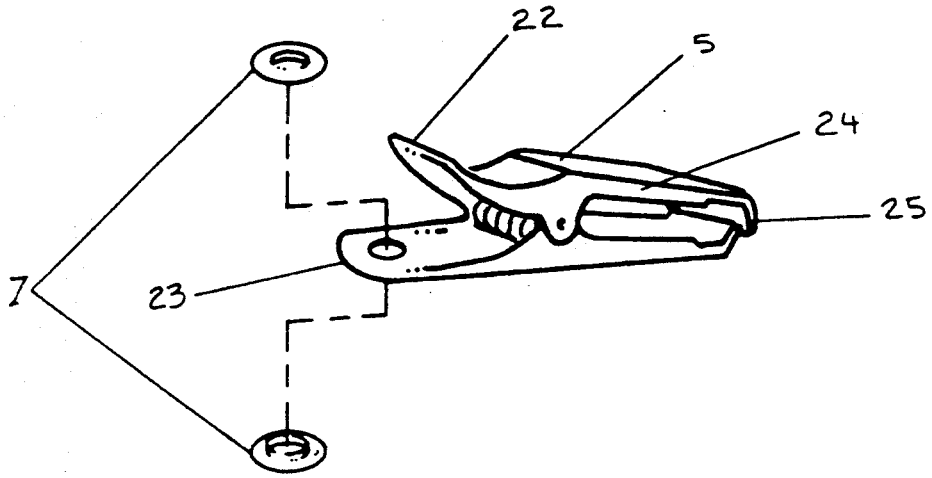

FIG. 7 is a side perspective view of the present invention showing a spring-loaded binder clip and one means for attaching it to the shield.

Figure 8:
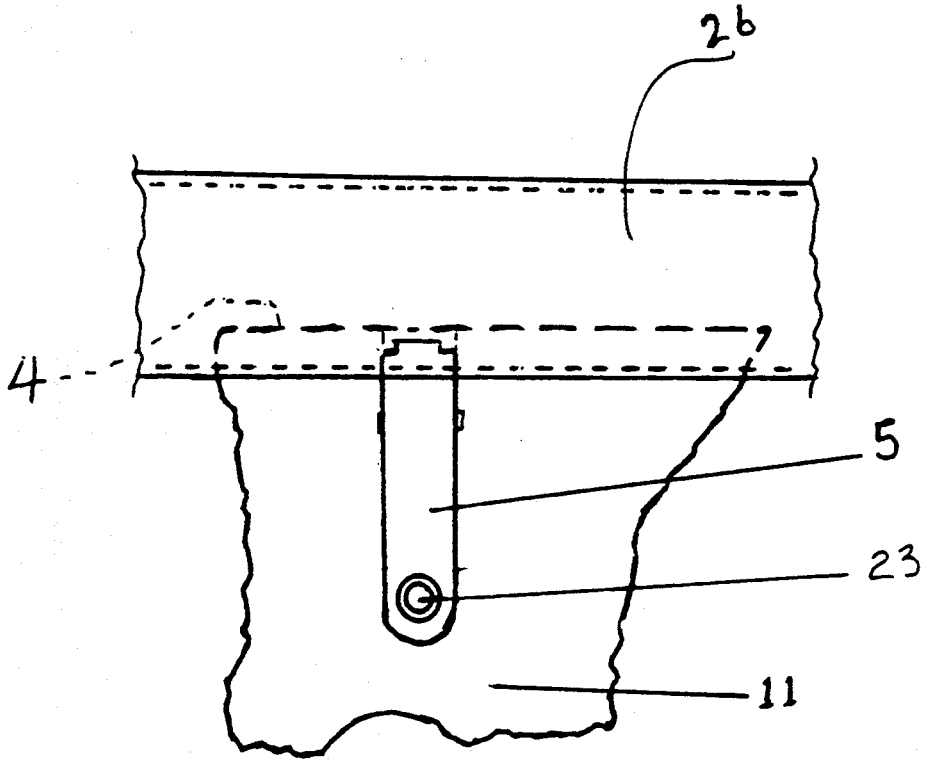

FIG. 8 is a view from the outside of a hat with the present invention attached showing a spring-loaded binder clip attached to a cutaway portion of the shield and temporarily attached to a cutaway portion of the base of a cap or a headband.

DESCRIPTION OF THE SPECIFIC EMBODIMENTS

Figure 1:
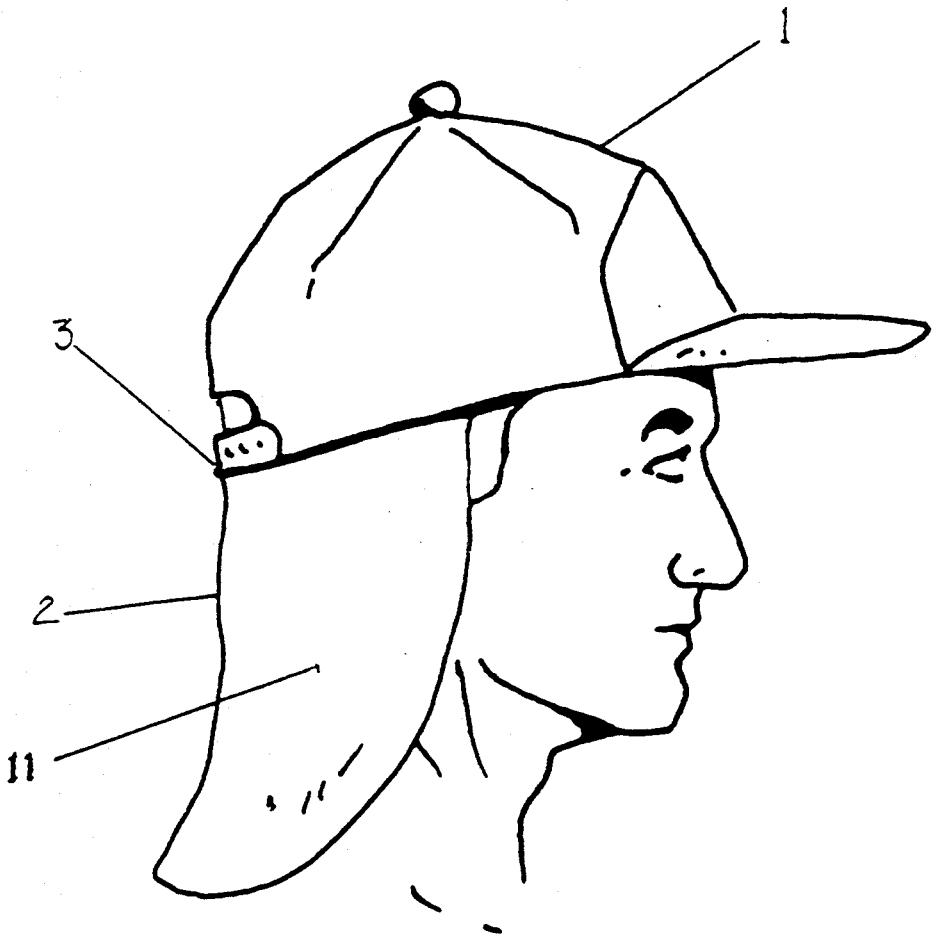
FIG. 1 is a side view of the present invention attached to an insignia cap or baseball cap on a wearer.

Referring now to the drawings, FIG. 1 is a side view of the protective headgear attachment 2 of the present invention. Headgear attachment 2 basically comprises a flexible paper, plastic or cloth shield 11. A conformable member 9 (FIGS. 3*a* and 6*a*) which is a pliable semi-rigid member that can be bent and formed to the posterior part of the head is enclosed within a hem or otherwise cooperatively provided along an edge 4 (FIG. 3) of the shield. To impart a finished appearance and to minimize wear at the edge, the circumference of the shield is covered by a plastic or cloth bias tape 8 (FIG. 6) attached to the edge of the shield in conventional ways. Alternatively, it may be finished by turning the outer edge of the shield 11 under and fixed by stitching or adhesive. The shielding material when laid flat possesses at its top edge 4 an arcuate shape as shown in FIG. 6. A typical size for an adult shield has a dimension approximately 37.5 cm in length along the upper edge shown in FIG. 6. Said length may be longer or shorter. Bias tape 8 is attached to the edges by cross-stitching, double-needle stitching, or pliable adhesives such as plastic or acrylic adhesives. The fabric used for the shield 11 will be most frequently fabricated from cotton or polyester cloth, or a blend thereof, treated with waterproofing chemicals. However, the construction of the shield 11 is by no means critical and it might be made from latex, canvas, mesh or the like. The fabric shield 11 can also be treated with "Poly Therm", the trademark for a chemical that provides desirable thermal characteristics affording the wearer additional warmth in cold weather or other cold environment and cooling in warm weather or other warm environment. Polly Therm comprises "cross-linked polyethylene glycols". It does not serve as an insulation; it cools and warms the shield 11 through the scientific process known as "heat of fusion" and "heat of crystallization". The effect is a range or temperature gradient up to six (6) degrees cooling from ambient temperatures in a warm environment and six (6) degrees warming from ambient temperatures in a cold environment, thus creating a temperature gradient up to (12) degrees from a summer to a winter environment.

Figure 2:
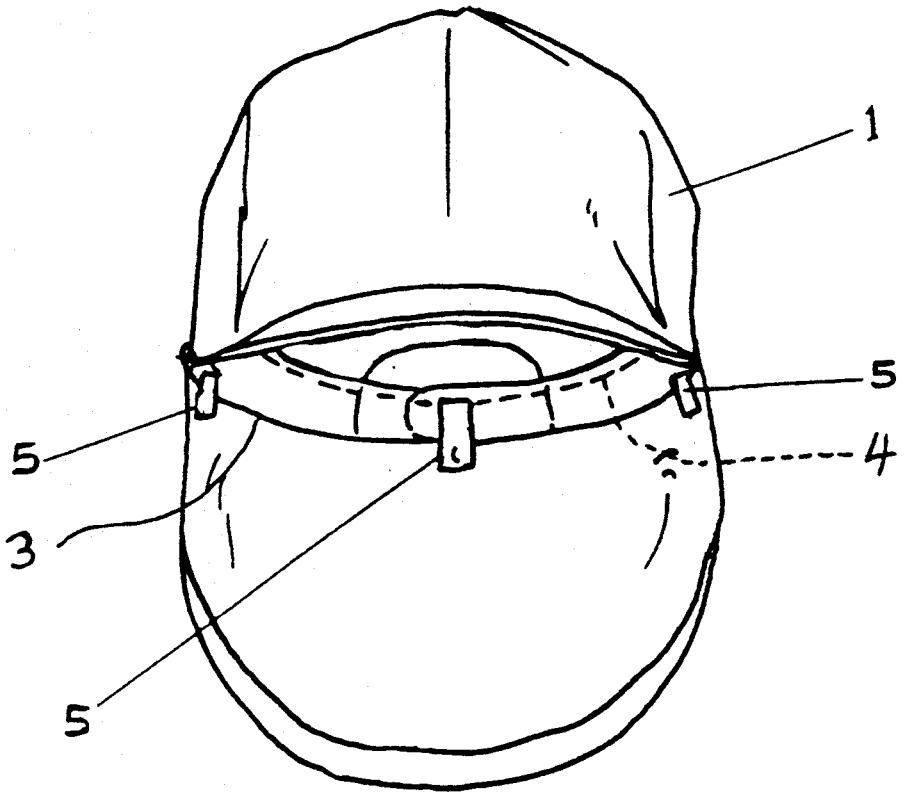
FIG. 2 is a front perspective view of the present invention attached to an insignia cap or baseball cap in the absence of a wearer showing the spring-loaded binder clips' location.

In general, when spread flat, the shield will have what may be termed a somewhat crescent-shaped appearance as shown in FIG. 6. That is, the two opposing edges generally define more or less arcuate outlines with conformable member 9 disposed generally along inner arcuate edge 4. The curvature of arcuate top edge 4 coupled with the proper location of the attaching members 5, as shown in FIG. 2, accomodates the curvature of the posterior of the wearer's head. Top edge 4 of headgear attachment 2 is parallel to bottom edge 3 of the hat or cap to which it is attached. The attachment is reversible and either surface of shield portion of attachment 2 can provide space for commercial advertisements such as logos or insignia supporting organizations, athletic teams, or for other visual messages. In other embodiments, the flexible shield may have a reflective character to aid identification at night, or may be impregnated with insect repellent. In addition, headgear attachment 2 is designed to allow for size-adjustment without disrupting the visual message. The conforming member 9 provides an accomodation for the use of earphones, telephones, or other listening conveniences. This conforming member 9 is constructed from any suitable formable member such as wire, Delrin (nylon) rod, or any other pliable material with molecular memory. If wire is used for conforming member 9, it is desirable to provide soft plastic coverings 10 on either end for safety purposes and to preclude undue wear. For purposes of oxidation resistance conforming member 9, if constructed of metal, can be encased in a non-corrosive material such as plastic or will be electroplated with a non-corrosive metal such as tin. Conforming member 9 is located within an elongated or tube-like covering which may be formed by bias tape 8 across the top edge of the headgear attachment 4 or by formation of a hem to enclose such member.

In a specific construction, (see FIG. 6) conforming member 9 is 37.5 cm in length across top edge 4 of headgear attachment 2 and continues an additional 8.5 cm extending from top edge 4 down either side. Thus, conforming member 9 is about 54.5 cm long. Conforming member 9 may be shorter or longer across top edge 4 and it may extend as desired down either side. In fact, if desired, conforming member 9 can be lengthened and adapted to traverse the entire circumference of shield 11 thus, the entire shield can be conformable.

Shield 11 will attach to several types of headgear 1 such as baseball caps, hats, construction hard hats, sweatbands, and military helmets. Attachment is made by engaging a plurality of attaching members 5 such as spring-loaded binder clips (three such clips are shown). Velcro, snaps, flat plastic strips, flat acrylic strips, buttons, rivets, or grommets, may be alternatively used to detachably mount the shield 11 with respect to the headgear. The attachment is made by engaging three attaching members 5 to bottom edge 3 of cap 1. The manner of using other attachment members 5 will be obvious. For example, Velcro may be glued or sewn to shield 11 and glued or sewn to the interior or exterior of the bottom edge 3 of cap or hat 1. Alternatively, flat strips may be glued, sewn, or pushed through shield 11, both ends bent upward for hanging shield 11 and one end of said strips would extend upward to the headband inside cap or hat 1 and may be glued or sewn to the headband, or they may simply be bent to hook over said headband.

FIG. 2 shows outside attaching members 5 are equidistant from the center attaching member. When using the spring-loaded binder clips as attaching members 5, shown enlarged in FIG. 7, each is attached to shield 11 by nickel-plated button snaps 7 at hole 23 of the clips. Attaching members 5 are so located to place and hold the top of headgear attachment 2 above the bottom edge of cap or hat 1. This allows for full coverage of the area and complete protection from the elements. The top gripping edges of two side attaching members 5 are such that they are even with the top edge of bias tape 8. The locations assure an even and latitudinally parallel positioning of top edge 4 of the attachment and the bottom edge 3 of cap 1.

Figure 3:
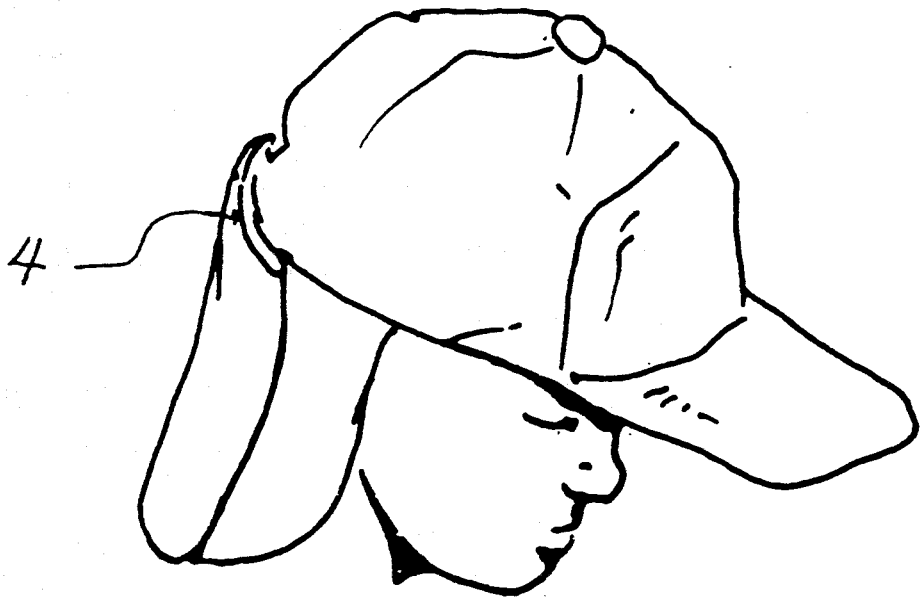

FIG. 3*a* shows how conforming member 9 may be reconfigured by bending to achieve a reduction in size. This reduction may be achieved by bending conforming member 9 at any point along top edge 4 of shield 2 to form a fold or folds as shown in FIG. 3, thus, in effect shortening top edge 4 to the desired degree. Size reduction would accomodate children's small head sizes as an alternative to providing differently sized accessories. Size reduction of conforming member 9 as shown in FIG. 3*a* allows ample uninterrupted display space on the outside surface of shield 11.

Another major advantage provided by conforming member 9 is depicted in a side perspective view in FIG. 4. Conforming member 9 can be turned backward on either side to shape shield 11 in a manner exposing the ear 12, thus providing accomodations for the use of headphones, telephones, verbal communications and traffic, factory, and office sounds. Both styling and comfort are important to many people, and as shown in FIGS. 5 and 5*a*, conforming member 9 provides this accomodation. Conforming member 9 can be shaped or bent to expose the ear 12 (FIG. 4) or open outward to one side, or both (FIGS. 5 and 5*a*). Such styling provides comfort, unrestricted auditory capabilities and increased flow of air between shield 11 and the wearer's head and neck.

FIG. 6 is a flat, inside view of headgear attachment 2. This view shows the underside of the said attachment. It shows the overall shape of headgear attachment 2, location of conforming member 9 covered by bias tape 8, and the relative positioning of attachment members 5 to shield 11. As shown in FIG. 6 the distance between end points 15 and 16 of edge 4 of headgear attachment 2 is generally 37.5 cm. FIG. 6*a* shows a fragmentary view of conforming member 9 and depicts its location inside bias tape 8 and extending downward 8.5 cm on either side; also shown in place is one of the safety coverings 10 used on the ends of the conforming member 9. Thus, conforming member 9 is a continuous system 54.5 cm in length. The length of conforming member 9 may be increased to any point on the circumference of shield 11 and to the point of traversing the entire circumference of headgear attachment 2. This would provide rigidity of the system as well as availability of the entire outer surface of the shield 11 for communication purposes or to accomodate collars on winter clothing.

FIG. 6 illustrates an example of the shape and size for headgear attachment 2 in accord with a specific embodiment. The distance between the center of top edge 4 and center of the bottommost edge of headgear attachment 2 is 23 cm. The depth of the top arc of the crescent shape, shown by reference number 21, is 3.5 cm. 3.5 cm. The greatest distance from side 19 to side 20 is 42 cm. The total circumference of this embodiment of headgear attachment 2 is 123.5 cm.

A spring-loaded binder clip is depicted in a side view in FIG. 7. The inverted thumb grip 22, when depressed, opens the overlapping jaws of attaching member 5. Shield 11 is attached to attaching members 5 at hole 23 by button snaps 7. The attaching members 5 comprise upper member 24 pivoted to a lower member and spring-loaded to grip the wearer's cap, hat, helmet, or headband with the overlapping jaws 25. Attaching members 5 are depicted in FIG. 8 with views of: (a) a cutaway of shield 11 attached to an attaching member (binder clip) 5 and (b) a cutaway of the wearer's cap, hat, or headband 26 gripped by attaching member 5.

Although the shield is shown in FIGS. 1, 2, and 8 as overlapping the headgear, it is obvious that shield top edge 4 could be positioned to abut or to underlap the edge of the headgear.

Other variations on a headgear accessory in accord with this invention may be used without departing from the spirit or scope of this invention as will be apparent to those of skill in the art.

What is claimed is:

1. A headgear attachment for providing protection for portions of the head and neck of a wearer against sunlight, rain or other conditions of weather, said attachment comprising:

a flexible shield of a size to cover portions of the back of the head and of the back of the neck of the wearer;

a relatively long, narrow, formable member having means by which the wearer, through manual bending, may impart a self-sustained shape to said formable member, said self-sustained shape including an effective length which may differ from the original length of said formable member before bending, whereby said formable member may be selectively made to conform to and fit the posterior portion of any one of a plurality of heads of different sizes;

means for attaching said formable member to said shield adjacent at least one edge of said shield so that, when said formable member is attached to said shield and then appropriately bent, said edge will acquire and retain said self-sustained shape as said self-sustained shape is imparted to said formable member; and attaching means on said shield adjacent said edge, whereby said headgear attachement may be secured to headgear and worn therewith.

2. The headgear attachment of claim 1 wherein said attachement members are attached to said shield in the vicinity of said formable member.

3. The headgear attachment of claim 1 wherein said shield is waterproof.

4. The headgear attachment of claim 1 wherein at least one surface of said shield is provided with a design or insignia.

5. The headgear attachement of claim 1 wherein said shield comprises a crescent shaped member and wherein said formable member extends substantially along an edge of an interior arc of the crescent shaped member.

* * * * *